United States Patent [19]

Ruckert

[11] Patent Number: 4,613,137

[45] Date of Patent: Sep. 23, 1986

[54] BOWLING BALL

[76] Inventor: Carl A. Ruckert, 1600 Edmar La., St. Louis, Mo. 63138

[21] Appl. No.: 710,548

[22] Filed: Mar. 11, 1985

[51] Int. Cl.[4] ..... A63B 37/14

[52] U.S. Cl. ..... 273/63 R; 273/63 D

[58] Field of Search ..... 273/63 R, 63 A, 63 B, 273/36 C, 63 D, 63 E, 63 F, 63 G, 128 A

[56] References Cited

U.S. PATENT DOCUMENTS

| | | | |
|---|---|---|---|
| 1,849,414 | 3/1932 | Turnbull | 273/63 E |
| 2,839,301 | 6/1958 | Hunter | 273/63 R |
| 3,400,929 | 9/1968 | Fabanich | 273/63 D |
| 3,924,856 | 12/1975 | DeKan et al. | 273/63 E X |
| 4,131,277 | 12/1978 | Randolph | 273/63 D |
| 4,133,527 | 1/1979 | Price | 273/63 D |
| 4,268,034 | 5/1981 | MacDonald | 273/63 C |
| 4,309,377 | 1/1982 | Miller, Jr. et al. | 264/294 |
| 4,461,478 | 7/1984 | Lee et al. | 273/63 R |
| 4,522,397 | 6/1985 | Miller et al. | 273/63 G |

FOREIGN PATENT DOCUMENTS 6407 of 1914 United Kingdom ..... 273/63 D

OTHER PUBLICATIONS

"Every Bowler's Training Manual", by Charles Robby Robinson and William H. Stanton, P.O. Box No. 3843, Glendale, Calif. 91201 (1966) pp. 102 & 103 & 104.

"Bowling", p. 28, publication date is before Jul. 1975.

*Primary Examiner*—George J. Marlo

*Attorney, Agent, or Firm*—Body, Vickers & Daniels

[57] ABSTRACT

A bowling ball having an outer shell comprised of at least two regions defining the outer surface of the ball, one region of a material having a predetermined surface hardness and the other region of a material having a softer surface hardness. The regions are disposed relative to each other such that rolling is effected on the softer surface and the harder surface is oriented in a pin engaging direction as the ball rolls.

11 Claims, 5 Drawing Figures

BOWLING BALL

BACKGROUND OF THE INVENTION

The present invention relates generally to bowling balls and, more particularly, to a new bowling ball having improved pin striking and lane tracking characteristics.

Modern bowling balls generally include a large spherical core which is surrounded and encapsulated by a relatively thin shell having a smooth spherical outer surface. This outer shell, sometimes referred to as the cover stock, may be formed from a variety of materials such as rubber, urethane, plastic, etc.

The composition and nature of the material used to form the cover stock affects the hardness and density of the outer surface of the bowling ball. In one respect, the hardness and density of the outer surface of a ball is important in that, to be approved by the American Bowling Congress (ABC), the cover stock must meet specific standards. A minimum criteria to be approved by the ABC is that the outer surface of the bowling ball must register a hardness of at least 72 Shore Durometer D (Shore D Hardness). As an upper limit the surface of the ball must not exceed 90 Shore D Hardness.

In another respect, the hardness of the outer shell is important in its relation to the balls ability to "track" or adhere to the bowling lanes and its striking power when impacting the bowling pins. Bowling balls with hard outer surfaces impact pins with superior striking force because the harder, denser outer surface does not yield or give upon impact with the pins. This provides better pin-to-pin mixing action which in turn promotes greater pin fall. A problem with these harder, denser balls, however, is that they generally have smoother, slicker outer surfaces, which surfaces have a low coefficient of friction with the lane. Thus, the spin applied to a bowling ball will less likely produce the conventional hooking action desired by the bowler to bring the ball into the pins in the so called "pocket" of the ten pin set-up. Bowling balls with the softer outer shells or cover stocks do provide greater adhesion with the lane, which adhesion allows the ball to hook and drive into the aforementioned "pocket", but the softer surface yields upon impact with the pins and therefore loses the strong pin action required for high pin fall and game scores. The present invention overcomes these and other problems and provides a bowling ball which provides the improved traction and driving action of soft shelled balls while at the same time providing the superior pin striking and pin fall producing capabilities of a ball having a hard dense outer surface.

SUMMARY OF THE INVENTION

In accordance with the present invention, there is provided a bowling ball having a spherical outer surface comprised of at least two separate regions, wherein one region is comprised of a material having an outer surface hardness greater than the other region. More specifically, the first region is comprised of a material having a predetermined surface hardness, which region defines a first portion of the outer surface area of the ball. The second region is of a material having a surface hardness less than the first region, which second region defines a second portion of the outer surface area of the ball and includes at least an area defined by an annular band extending around the ball. The surface areas of the first and second regions are located relative to each other and relative to the conventional finger and thumb holes in the ball in a way such that when the bowling ball is delivered in a conventional manner down the alley, rolling of the ball is effected on the region having the softer surface hardness, while the harder surface area of the first region is oriented during rolling in a direction such as to first impact the pin set-up on the alley. In this respect, the softer surface area provides greater frictional gripping or tracking engagement of the ball with the lane surface and produces greater hooking action and driving force of the ball into the pins. At the same time, the harder surface area oriented to engage the pins provides a more forceful pin contact and greater pin action. All these ball action and pin impacting characteristics promote greater pin fall and thus higher total game scores.

An object of the present invention is to provide a new and improved bowling ball having high performance pin striking power, together with exceptional hooking and lane tracking characteristics.

Another object of the present invention is to provide a ball as described above which meets the standards of the American Bowling Congress.

Another object of the present invention is to provide a bowling ball having an outer surface comprised of two regions, wherein one region is formed of a material having a surface hardness less than that of the other region, wherein the ball rolls on the region having the lesser surface hardness when normally delivered along the bowling alley.

A still further object of the present invention is to provide a bowling ball as referred to above which is inexpensive to manufacture and may be used by professionals and amateurs alike.

An even further object of the present invention is to provide a bowling ball which is suitable for use on a variety of lane surface conditions and has good tracking characteristics irrespective of such conditions.

BRIEF DESCRIPTION OF THE DRAWINGS

The invention may take physical form in certain parts and arrangement of parts, preferred and alternate embodiments of which will be described in detail in the following specification and illustrated in the accompanying drawings which form a part hereof and wherein.

DETAILED DESCRIPTION OF PREFERRED AND ALTERNATE EMBODIMENTS

Figure 1:
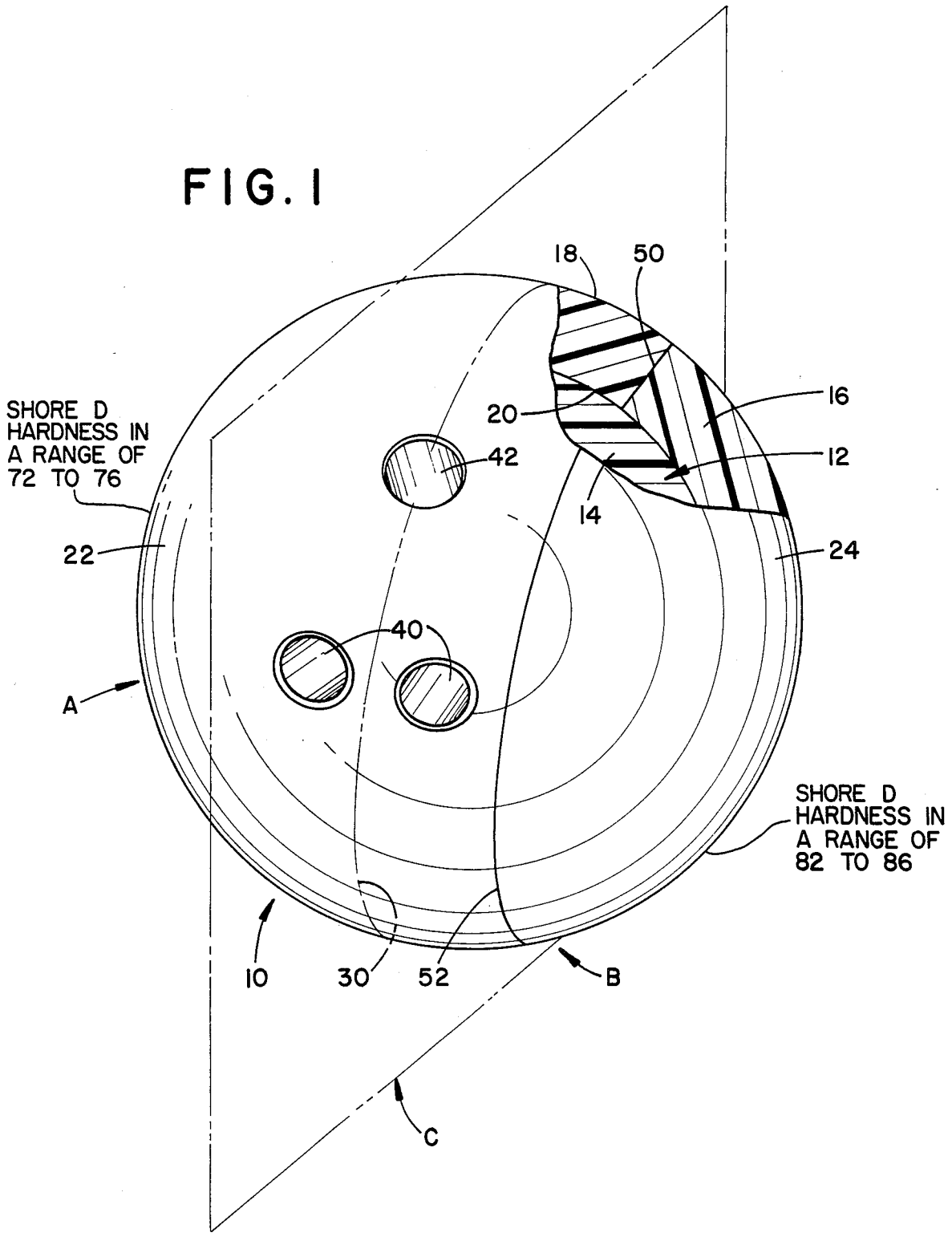
FIG. 1 is a perspective view, partially sectioned, of a bowling ball incorporating the concept of the present invention and provided with conventional finger and thumb holes.

Referring now to the drawings wherein the showings are for the purpose of illustrating the preferred embodiment of the invention only, and not for the purpose of limiting same, FIG. 1 shows a bowling ball 10, which includes a large spherical core 12 having an outer spherical surface 14. The core 12, in and of itself, forms no part of the present invention and therefore will not be described in great detail. As is conventionally known, the core of a bowling ball is generally formed of a natural or synthetic rubber mixed together with an inert filler such as sawdust or woodchips. A core may likewise be made of a resin used in place of the rubber. The inert material and the resin or rubber are compacted into a specific weight density, and cork may be added to adjust the weight thereof. It is conventionally known to incorporate a weight block (not shown) in the core to balance the ball and compensate for weight loss caused by the thumb and finger holes which are drilled into the ball. The core of the preferred embodiment is comprised of a mixture of sawdust impregnated with resin. Surrounding and encapsulating the core is an outer shell 16 having an outer surface 18 and an inner surface 20 bonded to core 12.

According to the present invention, the outer surface 18 of ball 10 is comprised of at least two regions 22 and 24 formed of materials having dissimilar surface hardness characteristics. Preferably, one region is comprised of a material having a hard, dense outer surface to provide an impact or striking surface which will not yield or deform or have a cushioning effect when engaging the bowling pins. The other region is comprised of a material having a relatively softer and more porous surface to provide a tracking or rolling surface. The surface of this region provides better lane gripping, or in other words better adhesion with the lane, which in turn affords better lane tracking characteristics serving to "drive" the ball into the pins.

As set forth in the background portion of the specification, the American Bowling Congress set specifications regulating the hardness of the outer cover stock between a range of 72 and 90 on a Durometer scale. According to the present invention, the harder material preferably has a Durometer hardness reading of over 80 and more specifically between 82 and 86. The softer material preferably has a Durometer hardness reading of less than 80 and more specifically between 72 and 76. The composition of the material forming these regions may be of any material suitable or approved for bowling ball constructions and including hardness values within said acceptable range of 72–90. Plastic, rubber, polyester or urethane for example are suitable materials used in bowling ball constructions. Each is capable of a wide range of surface hardness depending on their composition and the manufacturing procedures used in making the bowling ball. In these respects, the present invention may utilize either two dissimilar materials to form the two distinct regions of the ball or may utilize the same material of different composition in both regions wherein one region has a harder surface than that in the other region.

Figure 2:
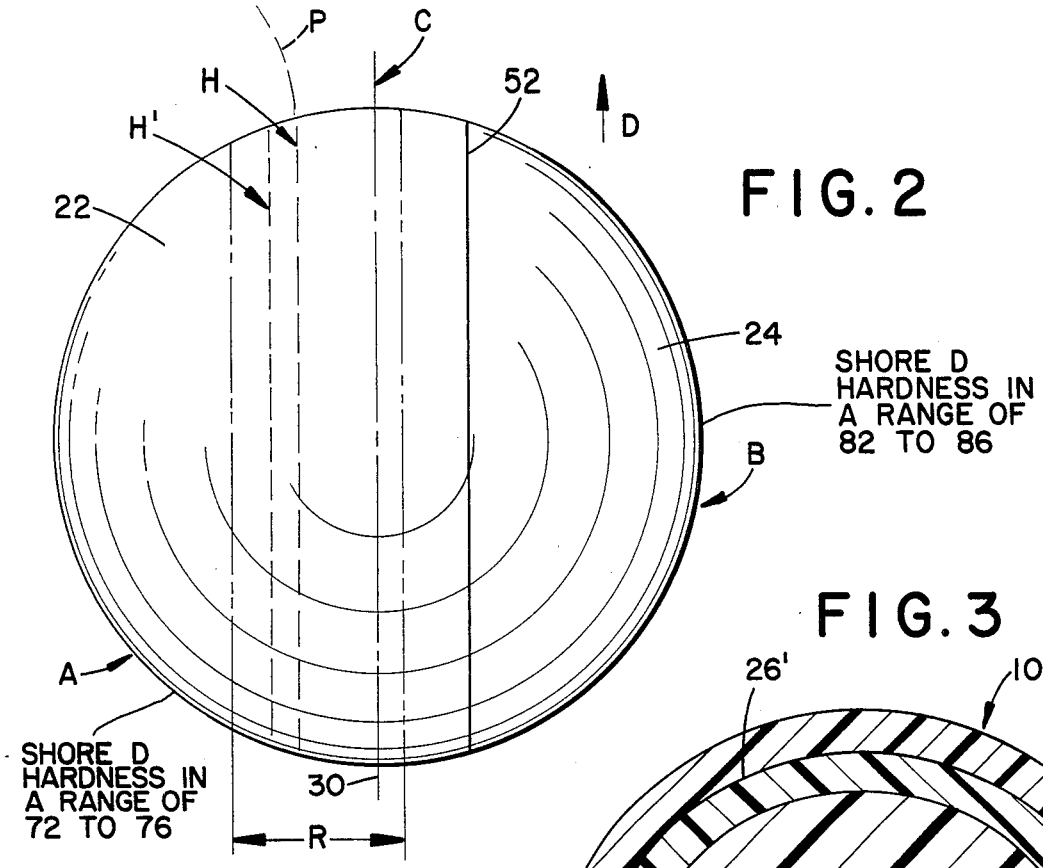
FIG. 2 is a plan view of the ball shown in FIG. 1.

Referring now to FIG. 1, for the purposes of describing and explaining the present invention only, the bowling ball may be considered as being formed by two imaginary hemispheres or zones A, B defined by a diametrical plane C passing through the center of the ball. The intersection of plane C with surface 16 also defines an imaginary parting line 30 separating zone A from zone B. As will be appreciated, because plane C passes through the center of the ball, line 30 represents the maximum diameter of the bowling ball. Regions 22, 24 are positioned with respect to each other such that when the ball is rolled down the bowling alley in a conventional manner by a bowler, the region having the softer more porous outer surface engages and rolls on the lane while the region having the harder outer surface is oriented in a direction to first engage the pins. FIG. 2 shows the ball for delivery in a direction D toward the pins on a bowling alley. The ball will be described for use by a right-handed bowler; however, it will be appeciated and understood from a further reading that the discussion and description of the present invention applies equally to a left-handed bowler. As is well known, the ideal bowling delivery will provide a certain amount of applied lateral spin to the ball which results in the conventional hooking action required for delivery of the ball into the pocket of the pins at the optimum angle. For a right-handed bowler, a ball thrown with sufficient will cause the ball to hook or curve along a path P as shown in FIG. 2. As is well known, a hooking ball does not roll on the maximum diameter of the ball but on a lesser diameter or annular line H which is generally laterally offset from the maximum diameter of the ball. In the orientation shown in FIG. 2, annular line H is offset to the left of maximum diameter 30 and lies in imaginary zone A.

As is appreciated, individual bowlers have unique bowling styles and thus one bowler may have a hook which is very different from another bowler. Consequently, the annular line H along, and on which, the ball rolls would be different for each type of bowler. At one extreme, a bowler may throw a straight ball which rolls straight down the lane with no hook. Such a ball would generally roll along imaginary line 30, i.e., the maximum diameter of the ball. On the other hand, a bowler may throw a ball with an extreme hook in which case the ball would roll on an annular line H' as seen in FIG. 2. Accordingly, most bowlers will throw a ball wherein the ball rolls on an annular line H which generally falls within a surface rolling band or region R as shown in FIG. 2, which band or region R extends annularly around the ball and is generally parallel to imaginary line 30. Most of region R, as illustrated in FIG. 2, extends to the left of line 30 into zone or hemisphere A. A small portion of region or band R extends into hemisphere or zone B. The reason for this is that although most balls thrown by a right-handed bowler will roll on line 30 or to the left thereof, an unusual throw or delivery may cause the ball to roll on an annular line or rolling diameter to the right of centerline 30. Accordingly, annular band R extends from the vicinity of centerline 30, i.e., an area adjacent either side of the centerline, to one side thereof.

With respect to the embodiment shown in FIGS. 1 and 2, region 22 which includes band R is comprised of the material having the soft, more porous outer surface, and region 24 is comprised of a material having the harder, dense outer surface. As best seen in FIG. 2, parting line 52 between softer region 22 and harder region 24 is situated to the right side of centerline C or, in other words, is situated in hemisphere or zone B. In this respect, region 22 defines a major portion of the total surface area of the ball and includes a portion of the surface area in hemisphere or zone B. The ball illustrated thus provides a rolling surface over the major portion of the ball. Region 24 which is comprised of the harder material and impacts the pins is located in zone B, generally on the opposite side of the ball than band or region R.

Finger holes 40 and thumb hole 42 drilled in the ball are illustrated in FIG. 1. With respect to the present invention, finger holes 40 and thumb hole 42 are located on the ball relative to the diametrical line 30 and region or band R to effect rolling of the ball on the annular band or region R when the ball is delivered by the bowler down the alley. The spacing between holes 40, 42 and their orientation relative to the centerline 30 of the ball will, of course, be determined by the hand dimensions, and preferences of an individual bowler. Accordingly, the position of the holes 40, 42 on the ball will vary from bowler to bowler. With respect to the present invention it is only important that the holes be located in a position to ensure rolling on annular band R.

With regard to the percentage of the total surface area of the ball defined by regions 22, 24, in the embodiment shown in FIGS. 1 and 2, region 24 formed of the harder material defines approximately 40 percent of the total surface area of the ball, which represents 80 percent of the surface area of zone or hemisphere B. Region 22 comprised of the softer, more porous material defines the remaining surface area of the embodiment shown. However, as set forth previously, the ball will generally roll along the surface defined by annular band or region R. Accordingly, with respect to the present invention, the soft and more porous surface area need only include an area defined by annular band or region R to provide the desired tracking and lane gripping characteristics. In this respect, it will be appreciated that for a skillful bowler, such as a professional, who is capable of consistently rolling the ball with the same hook, the ball would roll within a relatively narrow tracking band R. On the other hand, a less skilled bowler who is less capable of accurately controlling the ball would require a considerably wider rolling band or region R. Accordingly, the softer region of the ball can vary in size from a relatively narrow band wherein the percentage of the total surface area is small to a size as illustrated in FIGS. 1 and 2 wherein it defines most of the total surface area of the ball. As emphasized above, it is only important that region 22 of the soft material include at least an annular band portion R adjacent to and to one side of diametrical line 30, whereby such band portion is located relative to the finger and thumb holes 40, 42 to effect rolling of the ball on band or region R when the ball is set in motion by a bowler. In addition, it will be appreciated that the region 22 of softer material may assume the form of an annular band R alone having two harder surface areas adjacent either side thereof forming the remaining surface area of the ball.

In the embodiment shown in FIGS. 1 and 2, regions 22, 24 together form shell 16. Region 22 engages region 24 along an abutment 50 (FIG. 1) with each region engaging and interfacing with a portion of core 12. The interface abutment is defined by the inner surface 20 and outer surface 18 of shell 16 and has a shape of a flat annular ring. A parting line 52 between regions 22, 24 is defined on surface 16, which line 52 is generally parallel to band or region R. Regions 22, 24 are generally of identical thickness and each represents the entire thickness of the shell over its respective area. However, it will be appreciated that regions 22, 24 need not comprise the entire thickness of shell 16.

Figure 3:
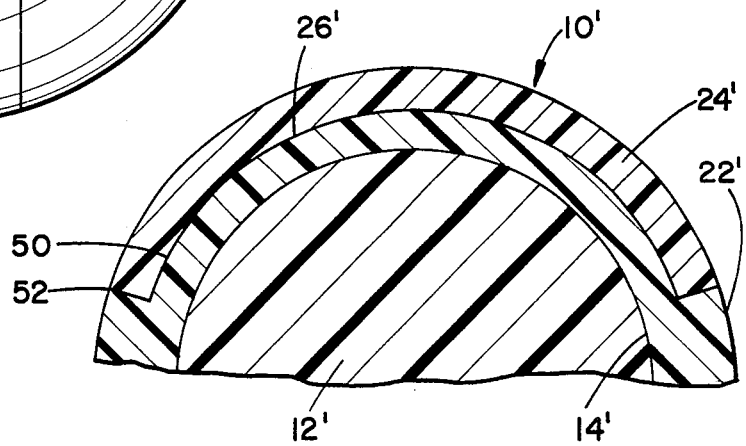
FIG. 3 is a partial sectional veiw of a bowling ball illustrating an alternative embodiment of the present invention.
Figure 4:
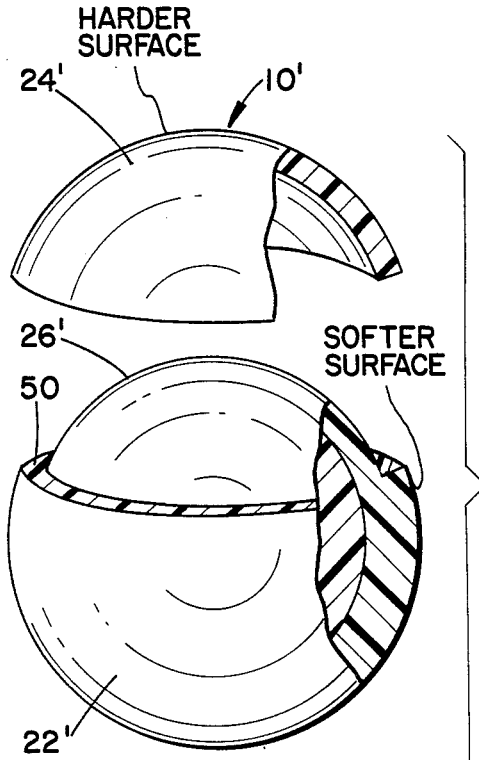
FIG. 4 is an exploded view partly broken away in section of the bowling ball shown in FIG. 3; and, FIG. 5 is a perspective, partially sectioned, view of a still further embodiment of the present invention.

FIGS. 3 and 4 show an alternate form of the bowling ball shown in FIG. 1 wherein region 22' totally surrounds and encapsulates core 12' to form a shell thereabout. As shown in the drawings, a region 24' is in the form of a cap or cover piece overlying and inset within a matching cavity 26' in region 22'. The cap 24' defines the region formed of the material providing a harder, denser, outer surface and, as illustrated in FIG. 3, is roughly half the thickness of the portion of the outer shell or cover stock 22' of the ball. As cap 24' is the impact region of the ball, the thickness thereof should be such as to resist a tendency to yield upon impact with the bowling pins. The general arrangement of the modified ball shown in FIGS. 3 and 4 could likewise be reversed such that the harder material totally encapsulates and surrounds core 12' to correspond to FIGS. 3 and 4, and the softer more porous material would be inset into cavity 26' of region 22' so as to overlie or cover such cavity. Accordingly, it is possible to provide a shell according to the present invention having regions of material having distinct outer surface characteristics by layering one material on the other. The thickness of either outer layer would be such that the desired characteristic of such region, i.e., the gripping of the soft material and the hard striking capability of the harder material, would be maintained.

Figure 5:
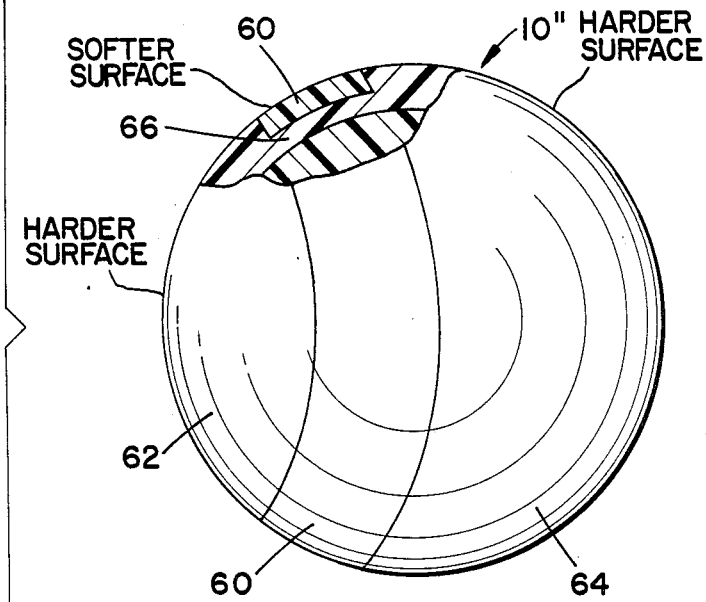

FIG. 5 shows an additional embodiment of the present invention wherein a ball 10'' has a region 60 formed of material providing a relatively soft porous outer surface. Region 60 is in the form of the annular band. Band 60 would include region R as described above, and may be of various lateral widths. In this embodiment, the ball is provided with two areas or regions 62, 64 of material having a harder, outer surface density, thereby providing a ball with impact surfaces on both sides of the rolling surface. Section 60 could be of a thickness equal to the thickness of the shell itself, wherein it would extend from outer surface 18 of the ball inwardly to the spherical surface of the core 12. However in the embodiment shown, band 60 is formed as an annular ring which surrounds a bridging portion 66 of the harder denser material which bridging portion 66 connects region 62 with region 64. Such ball thus provides an outer surface having a limited width tracking or rolling area of a softer material with a harder impact surface on either side thereof.

With respect to each of the embodiments shown and disclosed herein, bonding of the regions to each other and to the core is done in a manner as is conventionally known. It will be appreciated that the bond must be of sufficient strength to ensure no separation between the relative regions even after prolonged use of the bowling ball. Means for bonding cover stocks to balls is conventionally known and such means are suitable for use in the present invention.

In operation, a bowling ball according to the present invention is used like any other bowling ball. The present invention affords a bowler a bowling ball having better lane tracking and gripping characteristics together with a harder pin hitting action. The softer more porous material portion of the ball reduces sliding and helps drive the ball into the "pocket" of the tenpin setting on the bowling alley, while the harder denser material portion of the ball strikes or impacts into the pins with a sledge hammer effect, thereby producing greater pin action and greater pin fall and higher game scores. It will likewise be appreciated that the present invention reduces the need for bowlers to carry a variety of balls to accommodate various lane conditions.

The present invention has been described with reference to a preferred embodiment and modifications thereof. Other modifications and alterations will occur to those skilled in the art on a reading and understanding of the specification. For example, the bowling balls herein described and illustrated generally disclose separate and distinct regions having a discrete interface therebetween. It will be appreciated that through different methods of manufacture a ball may be formed of a continuous material wherein one region is integral with the other while at the same time having a different hardness. Likewise, the present invention is not limted to a bowling ball having a core and outer shell or cover stocks, in that solid balls having regions of hard and soft material could be made or formed. It is my intention to include all such modifications and alterations insofar as they come within the scope of the appended claims or equivalence thereof.

Having described the present invention, the following is claimed:

1. In a bowling ball for impacting erected tenpins on a bowling lane, said ball including a core encapsulated in and bonded to a spherical outer shell defining an outer surface, and having finger and thumb holes drilled therein, the improvement comprising:

said outer shell having a first distinct region comrised uniformly of a first material having a Short D hardness reading of between 82 to 86 wherein the outer surface of said first region defines a predetermined percent of the outer surface of said shell;

a second distinct region having an interface with said first region, said second region comprised uniformly of a second material having a softer and more porous composition than said first material, said second region defining the remaining portion of said spherical outer surface and including at least an annular surface band of predetermined width around said ball; and, said finger holes located relative to said first and second regions to effect rolling engagement of said annular surface band of the said second region with said lane when the ball is rolled down the lane, and to effect orientation of said first region of the ball relative to the direction of rolling movement thereof down the lane such that said first region of the ball initailly engages said erected tenpins.

2. A bowling ball as defined in claim 1, wherein said second region totally surrounds said core and said first region is layered thereon.

3. A bowling ball as defined in claim 1, wherein said second material has a uniform Short D Durometer hardness reading of between 72 and 76 and defines approximately 60 percent of the total surface area of said ball.

4. In a bowling ball having an outer spherical surface, and including an imaginary plane extending through the center of said ball and defining a first and a second imaginary hemispherical zone, said plane intersecting said surface to define an imaginary parting line between said hemispherical zones, the improvement comprising:

a first surface region of a material of uniform composition having a predetermined surface hardness of between 82 and 86 Shore D, said first region providing a major portion of the surface area of said first hemispherical zone; and, a second region formed of a material having a surface hardness less than said first region, said second region providing surface area in said second hemispherical zone, wherein said second region includes at least a surface area defined by an annular band extending around said ball, said band of predetermined width and generally parallel to said imaginary plane.

5. A bowling ball as defined in claim 4, including finger and thumb holes extending into said ball and located relative to said parting line to effect rolling on said annular band portion thereof when said ball is rolled down an alley.

6. A bowling ball as defined in claim 4, wherein said first region is a segment having a boundary generally parallel to said imaginary parting line and wherein said segment defines between 30 to 45 percent of the surface area of said ball and said second region provides the remaining surface area of said ball.

7. A bowling ball as defined in claim 4, further comprising a third region of a material having a surface hardness generally similar to said first region, providing surface area in said second hemispherical zone, wherein said second region is disposed between said first and third regions and provides a surface area defined by an annular band parallel to said imaginary plane.

8. A bowling ball for impacting tenpins on a bowling lane having a smooth spherical outer surface including first and second distinct sections, said first section comprised of a first material of uniform composition having a Short D hardness reading greater than 80 and defining a first portion of said spherical outer surface, said second section comprised of a second material of uniform composition having a Short D surface hardness less than said first material and defining a second portion of said outer surface, which second portion includes at least a surface area defined by an annular band extending around said ball, said first and second sections oriented relative to each other such that when finger holes are provided in said ball and said ball is rolled down said lane, said annular band is in rolling engagement with said lane, and said first portion of said outer surface initially engages said erect tenpins.

9. A bowling ball as defined in claim 8, wherein said ball includes a core encapsulated in and bonded to a spherical outer shell, said shell comprised of said first and second sections.

10. A bowling ball as defined in claim 8, wherein said first material has a Short D hardness of between 82 to 86, and said second material has a Shore D hardness of between 72 and 76.

11. A bowling ball as defined in claim 8, wherein said second section is an annular band extending around said ball defining an annular rolling surface, said second material forming said band having an approximate Shore D hardness of between 72 to 76, the remainder of said outer surface of said ball defined by said first material.

* * * * *